United States Patent [19]

Price et al.

[11] 4,184,565

[45] Jan. 22, 1980

[54] EXHAUST MUFFLER

[76] Inventors: Robert C. Price, 313 E. Fairchild, Midwest City, Okla. 73110; V. C. Harris, 5501 N. Brunson, Oklahoma City, both of Okla. 73112

[21] Appl. No.: 969,970

[22] Filed: Dec. 15, 1978

[51] Int. Cl.[2] ..... F01N 1/10; F01N 7/14; F01N 7/18

[52] U.S. Cl. ..... 181/252; 181/264; 181/281

[58] Field of Search ..... 181/248, 252, 256, 267, 181/270, 279–281, 274; 138/37, 38, 39, 42; 181/212, 264, 277, 247

[56] References Cited

U.S. PATENT DOCUMENTS

| | | | |
|---|---|---|---|
| 2,066,467 | 1/1937 | Gray | 181/247 |
| 2,230,221 | 2/1941 | Fitch | 138/42 |
| 3,522,863 | 8/1970 | Ignoggo | 181/252 |
| 3,561,562 | 2/1970 | Ignoggo | 181/256 |
| 4,129,196 | 12/1978 | Everett | 181/280 |

*Primary Examiner*—L. T. Hix
*Assistant Examiner*—Benjamin R. Fuller

[57] ABSTRACT

An exhaust muffler which includes a tubular metallic core having at least one layer of fiberglass around the tubular core. The core has a plurality of circumferential slots formed therethrough with the slots arrayed in spirals around the core. Each slot extends in a transverse or circumferential direction on the core, and has a width to length ratio of about 1:3 to about 1:5. A pair of spaced baffle bars are extended diametrically across the core at spaced locations along its length, and are oriented at right angles to each other in respect to the direction of extension across the longitudinal axis of the core.

12 Claims, 7 Drawing Figures

EXHAUST MUFFLER

BACKGROUND OF THE INVENTION

1. Field of the Invention

This invention relates to sound mufflers for vehicles, and particularly, to mufflers of the straight through, glass packed variety.

2. Description of the Known Prior Art

In sound muffling devices used for muffling the sound of operation of an internal combustion engine by passage of exhaust gases from the engine through the muffling device, various types of mufflers have been heretofor proposed and placed in use. In the so called glass pack mufflers, a generally cylindrical shell is used to enclose a layer of glass fiber which surrounds an internal tubular core through which the exhaust gases are passed. The core may be perforated in various ways, and certain types of constrictions or baffle structures can be provided in the core to impart turbulence to the through-flowing exhaust gases, and reduce the noise level of operation of the engine.

It is important in the design construction of mufflers of the type described that any constriction or baffling which is provided not develop excessive back pressure to the exhaust valves of the engine, since this will result in early burning and malfunction of the valves. Moreover, the materials of which the muffler itself is constructed, and particularly the core, must be such, considering the manner in which the exhaust gases flow therethrough, that early burn-outs of the muffler, in which the metal is embrittled and destroyed, do not occur.

Examples of mufflers of the type described, as such have been disclosed in previously issued patents, include those which are illustrated and discussed in U.S. Pat. Nos. 1,638,780 to Neil; 1,861,775 to Aseltine; 2,251,880 to Carey et al.; 2,047,443 to Starkweather et al.; 3,522,863 to Ignoffo and 3,561,562 to Ignoffo.

The prior art thought to be most pertinent with respect to the present invention is that which is illustrated in the two Ignoffo patents referred to above, and in the Aseltine patent. This invention, however, presents certain advantages with respect to the structures in each of these patents, with such advantage residing particularly in the dimensioning and arrangement of certain slots provided in the internal core of the straight-through glass pack muffler, and certain fractional baffling devices in the form of baffle bars which are inserted at certain critical points over the length of the internal tubular core of the muffler.

BRIEF DESCRIPTION OF THE PRESENT INVENTION

The present invention provides an improved straight-through engine exhaust muffler and core therefor, with the principle improvement being in the manner in which the core element is constructed. Basically, the overall muffler of the invention includes such core within a fiberglass sheath or layer, with both the sheath and the core enclosed within a tubular shell. The core, per se, has a plurality of circumferential slots formed therethrough, with such slots arrayed in spirals around the core. Each slot extends in a transverse or circumferential direction on the core, and has a width to length ratio of from about 1:3 to about 1:5. A pair of spaced baffle bars are extended diametrically through the core at spaced locations along its length, and are oriented at right angles to each other in respect to their direction of extension across the longitudinal axis of the core.

The unique core of the invention has been found to function very effectively, in conjunction with a surrounding glass pack, in suppressing sound of the exhaust from an internal combustion engine, and does so without developing damaging back pressure at the location of the engine exhaust valves.

An important object of the invention is to provide an improved exhaust muffler for use with internal combustion engines, which muffler is of relatively simple and economical construction, but which affords improvement over prior art structures in the efficiency with which the noise level experienced during operation of the engine is reduced.

Another object of the invention is to provide an improved core for a straight through, glass pack exhaust muffler which can be easily and more economically manufactured than many types of previously known slotted muffler cores where an arcuate cutting edge carried on a slotting die has been used for making the slots in the core.

A further object of the invention is to provide a slotted tubular muffler core for use in a straight through, glass packed muffler, in which core the slots have a relatively large surface area, but do not have a dimensional configuration by reason of which the mechanical strength of the core is significantly weakened.

In addition to the foregoing described objects and advantages of the invention, additional objects and advantages will become apparent as the following detailed description of the invention is read in conjunction with the accompanying drawings.

GENERAL DESCRIPTION OF THE DRAWINGS

DETAILED DESCRIPTION OF A PREFERRED EMBODIMENT OF THE INVENTION

Figures 1, 2, 3:
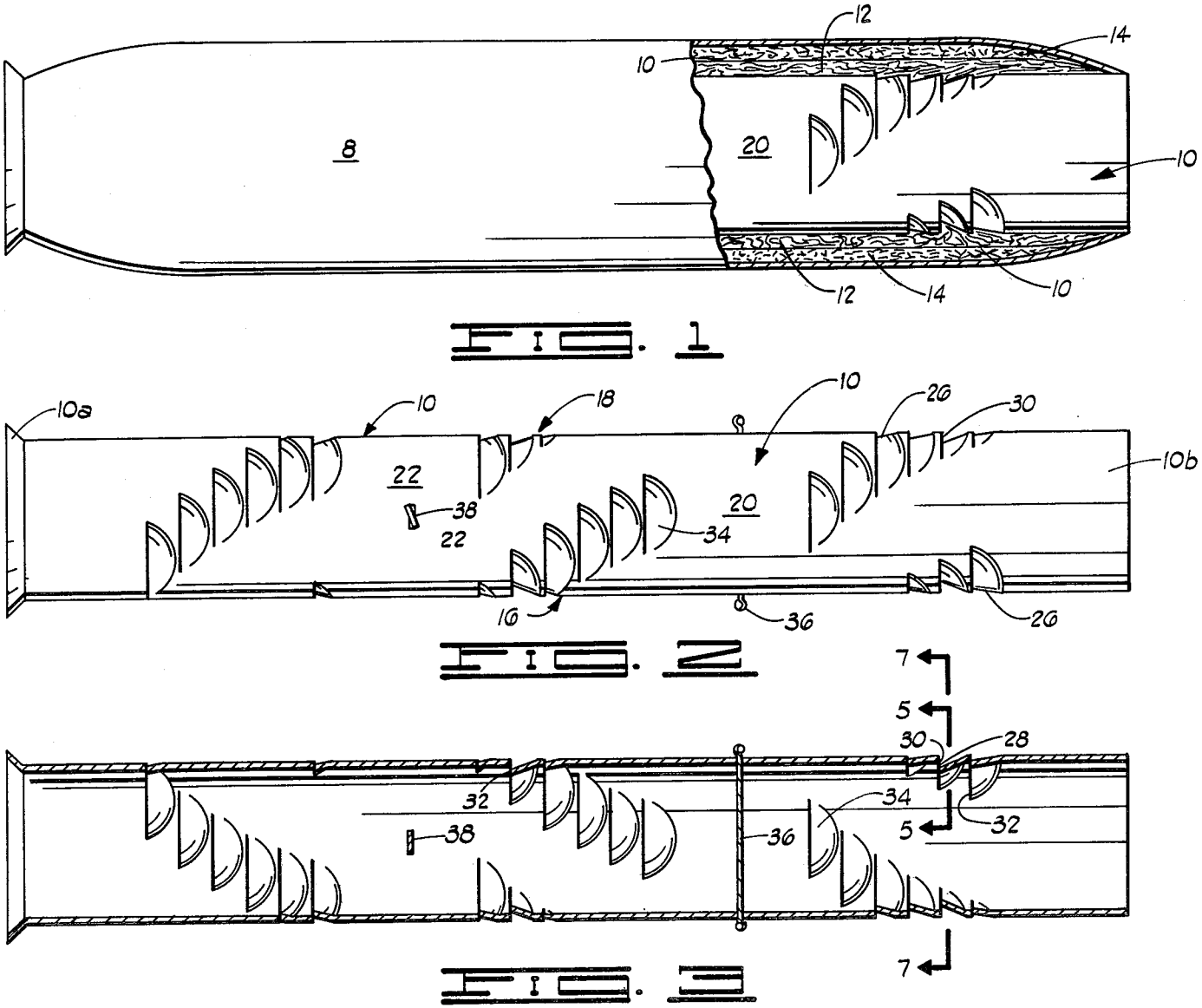
FIG. 1 is a side view, partially in elevation and partially in section, of an exhaust muffler constructed in accordance with the present invention.
FIG. 2 is a view in side elevation of a tubular core used in the exhaust muffler of the present invention.
FIG. 3 is a longitudinal sectional view of the tubular core shown in FIG. 2.

Referring initially to FIG. 1 of the drawings, illustrated therein is an exhaust muffler constructed in accordance with the invention. The exhaust muffler includes an external rigid metallic jacket 8 and an elongated tubular core designated generally by reference numeral 10. The tubular core 10 is surrounded over a major portion of its length by a first layer 12 of long-stranded fiberglass, and a surrounding, external layer 14 of relatively short-stranded fiberglass. The layer 12 of the fiberglass functions as a heat shield, and the external layer 14 functions as a silencing layer.

The tubular core 10 of the muffler is illustrated in greater detail in FIG. 2 of the drawings. The core 10 is generally cylindrical in configuration and is formed of a suitable metal such as steel. Typically the tubular core will be from about $1\frac{1}{4}$ to $2\frac{3}{4}$ inches in diameter, and includes a first end 10*a* which flares outwardly as shown in the drawings, and a second end 10*b*. Formed through the walls of the core are a plurality of circumferentially spaced, spirally turned rows of transversely extending slots.

Figure 4:
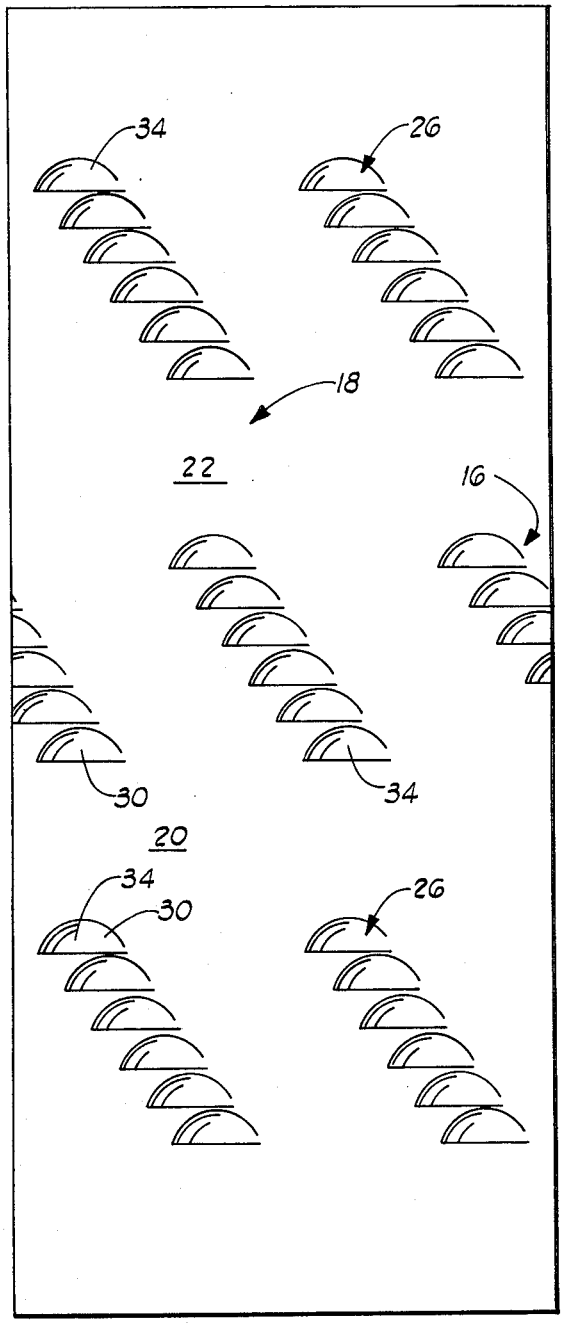
FIG. 4 is a diagrammatic illustration of the way in which the slots in the tubular core are arranged in the metal sheet of which the core is formed.

In the illustrated embodiment of the invention, two of the rows 16 and 18 of the slots are provided, and are disposed 180° from each other around the outer periphery of the core. It will be noted in referring to FIGS. 1, 3 and 4 that the spiral rows 16 and 18 of the slots in the muffler core are interrupted at two points, so that each spiral row includes three groupings of slots with the central grouping separated from the end groupings as indicated at locations 20 and 22 on the side of the muffler core. Each of the spiral rows of slots extends over a major portion of the length of the muffler core which is preferably at least four-fifths of the core length. The spiral rows 16 and 18 of the slots are also each characterized in turning through 270° from the point where the spiral row begins adjacent one end of the muffler to the point where it terminates adjacent the other end of the muffler core.

Figure 5:
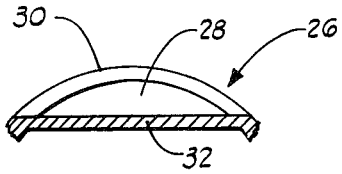
FIG. 5 is a sectional view taken along line 5—5 of FIG. 3.
Figure 6:
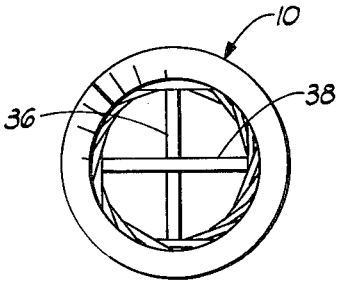
FIG. 6 is an end view in elevation of the tubular core.

Each slot formed in the core is designated generally by reference numeral 26. The configuration, dimension and arrangement of the slots is an important feature of the present invention. The slots are formed so that the openings into the interior of the tubular core, as typified by the slot opening 28 shown in FIGS. 3 and 5, lie in a plane which extends normal to the longitudinal axis of the tubular core. Stated differently, the openings 28 of the several slots face axially toward one of the ends of the core, as contrasted with facing in a radially outward direction.

The slots 26 in the core 10, while extending transversely in the manner described, may also be described as extending circumferentially on the core. This implies that the length of each slot in a circumferential direction is greater than any dimension of the slot extending in an axial direction. Of course, since the slot openings 28 lie in planes which extend substantially normal to the longitudinal axis of the core, a longitudinal dimension of each slot, if it exists at all, is relatively small.

The slots 26 are formed so that an opening 28 of relatively large area is characteristic of each slot, considering the perimeter dimension of the portions of the tubular core which define the boundaries of the slot. In other words, the opening area is maximized relative to the perimeter of the opening to permit gases to escape from the interior of the core with relatively little impedence. To better understand this arrangement, each of the slots 26 can be considered in terms of the slot edges which extend around each opening 28. Each of the openings 28 is defined by an upper slot edge 30 which lies at the upper or radially outer side of the opening 28, and by an inner slot edge 32 which lies at the radially inner side of each slot 28. The upper slot edge 30 is arcuate in configuration, conforming to a segment of the outer periphery of the tubular core 10. The inner slot edge 32 is relatively straight, though it may assume a slight concavity, and at its opposite ends, intersects and is joined to the upper slot edge 30. Each of the openings 28 is thus, in essence, a segment of a circle.

In order to achieve the relatively large area opening sought, while minimizing the length of the upper and lower slot edges 30 and 32, it is preferred that the length of each slot, as measured transversely thereacross (in a plane which extends normal to the longitudinal axis of the tubular core) have a ratio to the width of the slot, as constituted by the greatest distance between the upper slot edge and the lower slot edge, which is between about 3:1 and 5:1. In the tubular cores of the type here under consideration, i.e., having diameters of from about $1\frac{1}{4}$ inch to about $2\frac{3}{4}$ inches, the slot openings 28 are preferably characterized in having a length of from about 1 to $1\frac{1}{2}$ inch, and the upper and lower edges of the slot opening are spaced from each other a distance of from about 3/16 to $\frac{3}{8}$ inch at their point of greatest separation. As a final element of each of the slots 26, the tubular core 10 includes a plurality of substantially flat portions 34, with one of such substantially flat portions being located adjacent, and terminating at one of the lower slot edges 32.

In forming the tubular core 10 with the slots therein, a slotting die is used which carries a chisel edge at one end thereof. The bevel extending from the straight chisel or slotting edge back into the shank of the cutting die forms an angle with the longitudinal axis of the slotting die of about 30° to 45°. In the fabrication of the core, two such slotting dies are aligned on opposite sides of the unslotted tubular core, and are reciprocated inwardly to radially impact the tubular core and cut the slots 26 therein in the configuration shown. During the use of the slotting dies, the tubular core is advanced in the direction of its longitudinal axis, and is slowly rotated so that the spiral configuration of the slot rows 16 and 18 is attained.

An important feature of the present invention is the manner in which the slots are arranged, and the particular configuration of each individual slot 26. By making each slot 26 relatively deep while keeping the length of the slot in a transverse direction relatively short, maximum area is imparted to the opening 28 of each slot without extending either the upper slot edge 30 or the lower slot edge 32 over any substantial portion of the total circumferential dimension of the tubular core. This greatly aids in maintaining the strength of the core, and extending the effective service life of the core. Slotted muffler cores which have been previously produced, in which the slots formed through the wall of the core extend over as much as one-fourth to almost one-half of the total peripheral extent of the core are substantially weaker and less efficient and are shorter lived. Further, where a relatively narrow, long slit was previously formed in muffler core slotting by using arcuately edged slotting dies, the ability of hot exhaust gases to escape through the slots without undesirable throttling action was impeded. Importantly also, this method of cutting the slots resulted in a localized flattening of the tube, causing the core to be out-of-round at several places along its length, resulting in a further loss in sound suppressing efficiency.

A further important structural aspect of the present invention is the inclusion in the muffler core of a pair of baffle bars which are made to extend diametrically through the tubular core 10 at longitudinally spaced intervals therealong. In a preferred embodiment of the invention, two of such baffle bars are employed. Thus, in the drawings, a first baffle bar 36 is illustrated as positioned in the tubular core 10 at a location about one-third of the distance from one end of the core to the other. A second baffle bar 38 is spaced from the baffle bar 36 about half of the remaining distance to the opposite end of the tubular core, so that baffle bars are spaced from each other a distance which is substantially equivalent to their spacing from the opposite ends of the core.

Each of the baffle bars 36 and 38 is dimensioned so that its transverse width does not exceed about one-fourth the diameter of the tubular core 10. Preferably the transverse width is even smaller in relation to the diameter of the tube. In a preferred embodiment of the invention, in which the elongated tube has a diameter of from about $1\frac{1}{4}$ to $2\frac{3}{4}$ inches, the transverse width of the baffle bars is between about 5/16 inch and about 7/16 inch, and most desirably is $\frac{3}{8}$ inch.

Figure 7:
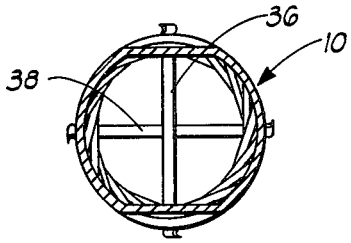
FIG. 7 is a transverse sectional view through the tubular muffler core.

In mounting the baffle bars 36 and 38 in the tubular core 10, a pair of small aligned slits are formed on opposite sides of the tubular core, and the respective baffle bar is forced through these slits so that its opposite ends project on the outer sides of the tubular core. These ends are then turned over or crimped so that the baffle bars are, of necessity, retained in position coincident with diameters of the tubular core. It will be noted in referring to FIGS. 3 and 7 of the drawings that the two baffle bars 36 and 38 are oriented so that they extend at 90° to each other. Stated differently, the baffle bar 38 lies in a plane which extends normal to the baffle bar 36.

Although a preferred embodiment of the invention has been herein described, it will be understood that various changes and modifications in the preferred embodiment herein illustrated and described can be effected without departure from the basic principles which underlie the invention. Changes and innovations of this type are therefore deemed to be circumscribed by the spirit and scope of the invention except as the same may be necessarily limited by the appended claims or reasonable equivalents thereof.

What is claimed is:

1. A core for an exhaust muffler comprising:

an elongated tube of from $1\frac{1}{4}$ to $2\frac{3}{4}$ inches in diameter having first and second ends and having a plurality of circumferentially spaced spiral rows of slots therein, said slots each extending transversely with respect to the longitudinal axis of the tube, and each of said slots defining an open space lying in a plane extending substantially normal to the longitudinal axis of the tube, and said tube further including:

arcuate upper slot edges at the radially outer sides of said open spaces;

lower slot edges at the radially inner sides of said open spaces and having a length of from about 1 to $1\frac{1}{2}$ inch, said upper and lower edges being spaced from each other a distance of from about 3/16 to $\frac{3}{8}$ inch at their point of greatest separation; and substantially flat portions adjacent each of said lower slot edges and each terminating at the respective adjacent lower slot edge;

a first baffle bar having a transverse width not exceeding about one-fourth the diameter of the tube extending diametrically across the inside of the tube at a location between the longitudinal center of the tube and the first end thereof; and a second baffle bar having a transverse width not exceeding about one-fourth the diameter of the tube extending diametrically across the tube at a location between the longitudinal center of the tube and the second end thereof, said second baffle bar extending in a diametric plane of the tube which extends normal to the first baffle bar.

2. A core for an exhaust muffler as defined in claim 1 wherein there are two of said spiral rows disposed 180° from each other around the periphery of the tube.

3. A core for an exhaust muffler as defined in claim 2 wherein each of said spirals extends around 270° of the total circumferential extent of the tube and covers at least four-fifths of the total length of the tube.

4. A core for an exhaust muffler as defined in claim 1 wherein adjacent slots in each of said rows are spaced from each other by from about $\frac{1}{2}$ to $\frac{5}{8}$ inch.

5. A core for an exhaust muffler as defined in claim 1 wherein the slots in each of said rows are arrayed in three spaced groups including a center group disposed between said first and second baffle bars, and two end groups each located between one of said baffle bars and an end of said elongated tube.

6. A core for an exhaust muffler as defined in claim 1 wherein each of said baffle bars has a width of from about 5/16 inch to about 7/16 inch.

7. A core for an exhaust muffler as defined in claim 6 wherein there are two of said spiral rows disposed 180° from each other around the periphery of the tube.

8. A core for an exhaust muffler as defined in claim 7 wherein each of said spirals extends around 270° of the total circumferential extent of the tube and covers at least four-fifths of the total length of the tube.

9. A core for an exhaust muffler as defined in claim 8 wherein the slots in each of said rows are arrayed in three spaced groups including a center group disposed between said first and second baffle bars, and two end groups each located between one of said baffle bars and an end of said elongated tube.

10. An exhaust muffler comprising:

a tubular core having a plurality of circumferentially spaced spiral rows of transversely extending slots therein;

a first baffle bar extending diametrically across the tubular core at a location approximately one-third of the distance from one end of the tubular core to the other;

a second baffle bar extending diametrically across the tubular core at a location approximately two-thirds of the distance from one end of the tubular core to the other, said second baffle bar being oriented at 90° with respect to the first baffle bar as both are viewed along the longitudinal axis of the tubular core from either end thereof;

a first layer of relatively long strand fiberglass around said tubular core forming a heat shield surrounding the core; and a second layer of relatively shorter strand fiberglass around said tubular core forming a silencing layer.

11. An exhaust muffler as defined in claim 10 wherein each of said baffle bars has a transverse width not exceeding about one-fourth the diameter of said tubular core.

12. An exhaust muffler as defined in claim 10 wherein there are two of said spiral rows disposed 180° from each other around the periphery of the tube, each of said spiral rows extending around 270° of the total circumferential extent of the tube and covering at least four-fifths of the total length of the tube.

* * * * *